US009075329B2

(12) United States Patent
Morales-Tirado et al.

(10) Patent No.: US 9,075,329 B2
(45) Date of Patent: Jul. 7, 2015

(54) EMULSION AGGREGATION TONERS WITH IMPROVED PARTICLE SIZE DISTRIBUTION

(71) Applicant: Xerox Corporation, Norwalk, CT (US)

(72) Inventors: Juan A. Morales-Tirado, Henrietta, NY (US); Mark A. Jackson, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 63 days.

(21) Appl. No.: 13/838,774

(22) Filed: Mar. 15, 2013

(65) Prior Publication Data

US 2014/0272702 A1 Sep. 18, 2014

(51) Int. Cl.

| | |
|---|---|
| ***G03G 9/087*** | (2006.01) |
| ***G03G 9/08*** | (2006.01) |
| ***G03G 9/093*** | (2006.01) |

(52) U.S. Cl.

CPC ..... *G03G 9/0825* (2013.01); *G03G 9/0802* (2013.01); *G03G 9/09314* (2013.01); *G03G 9/09357* (2013.01); *G03G 9/09392* (2013.01)

(58) Field of Classification Search

CPC . G03G 9/08; G03G 9/08711; G03G 9/08795; G03G 9/08797; G03G 9/093

USPC ..... 430/110.2, 110.3, 110.4, 109.3

See application file for complete search history.

(56) References Cited

U.S. PATENT DOCUMENTS

| | | | | |
|---|---|---|---|---|
| 5,227,460 | A | 7/1993 | Mahabadi et al. | |
| 6,004,714 | A | 12/1999 | Ciccarelli et al. | |
| 6,190,815 | B1 | 2/2001 | Ciccarelli et al. | |
| 2006/0154162 | A1* | 7/2006 | Zhou et al. | 430/108.1 |
| 2007/0048643 | A1* | 3/2007 | Kmiecik-Lawrynowicz et al. | 430/108.6 |
| 2011/0086306 | A1* | 4/2011 | Bayley et al. | 430/108.2 |
| 2012/0040285 | A1* | 2/2012 | Shibata et al. | 430/110.2 |
| 2012/0129089 | A1* | 5/2012 | Kmiecik-Lawrynowicz et al. | 430/108.3 |

FOREIGN PATENT DOCUMENTS

EP 1442835 A1 8/2004

* cited by examiner

*Primary Examiner* — Peter Vajda

(74) *Attorney, Agent, or Firm* — Pillsbury Winthrop Shaw Pittman LLP

(57) ABSTRACT

A method of making toner particles that includes forming a pre-shell aggregate mixture by adding to a reactor pre-shell aggregate ingredients, the includes a latex resin, the reactor having a mixing impeller and a heating jacket; performing pre-shell aggregation while homogenizing the pre-shell aggregate mixture with the impeller at an initial tip speed to form pre-shell aggregates; decreasing the tip speed to a second tip speed when the pre-shell aggregates reach a target intermediate average particle diameter; and then decreasing the tip speed at one or more intervals between when the pre-shell aggregates reach the target intermediate average particle diameter and when the pre-shell aggregates reach a target final average particle diameter so that the tip speed meets the following formula:

tip speed=1644ft/min−204.9(ft/(min*μm))*average particle diameter(μm).

12 Claims, 5 Drawing Sheets

EMULSION AGGREGATION TONERS WITH IMPROVED PARTICLE SIZE DISTRIBUTION

TECHNICAL FIELD

The present disclosure is generally related to toner compositions and methods for producing such toners used in forming and developing images of good quality. Specifically, this disclosure is directed to improving the charge distribution and the particle size distribution in an emulsion aggregation toner.

BACKGROUND

Electrophotographic machines having a selective development system, such as a single component development system, may have improved printing properties if a toner having a very narrow toner charge distribution is used. Conventional methods for narrowing toner charge distribution include an additive blend process and formulation optimization, increasing the sphericity of the toner particles, and physically separating the particles via wet sieving.

SUMMARY

Provided is a method of making toner particles, comprising forming a pre-shell aggregate mixture by adding to a reactor pre-shell aggregate ingredients, the pre-shell aggregate ingredients comprising a latex resin, optionally a wax, optionally a colorant, optionally a surfactant, optionally a coagulant, optionally a chelating agent; and optionally one or more additional additives, the reactor comprising a mixing impeller and a heating jacket; performing pre-shell aggregation while homogenizing the pre-shell aggregate mixture with the impeller at an initial tip speed to form pre-shell aggregates; decreasing the tip speed to a second tip speed when the pre-shell aggregates reach a target intermediate average particle diameter; and then decreasing the tip speed at one or more intervals between when the pre-shell aggregates reach the target intermediate average particle diameter and when the pre-shell aggregates reach a target final average particle diameter so that the tip speed meets the following formula:

$$\text{tip speed}=1644\text{ft/min}-204.9(\text{ft}/(\text{min}*\mu\text{m}))*\text{average particle diameter}(\mu\text{m});$$

stopping pre-shell aggregation when the pre-shell aggregates reach the target final average particle diameter; adding a shell latex to the pre-shell aggregates; and forming shells around the pre-shell aggregates to obtain post-shell aggregates.

Also provided is a toner composition comprising toner particles comprising: a core; and a shell surrounding the core; wherein: a ratio of an average particle diameter of the toner particles to an average particle diameter of the core is from about 1.1 to about 1.2; the toner particles have a particle size distribution with a lower number ratio geometric standard deviation (GSDn) of from about 1.18 to about 1.20, and an upper geometric standard deviation by volume (GSDv) of from about 1.16 to about 1.17.

EMBODIMENTS

Figure 1:
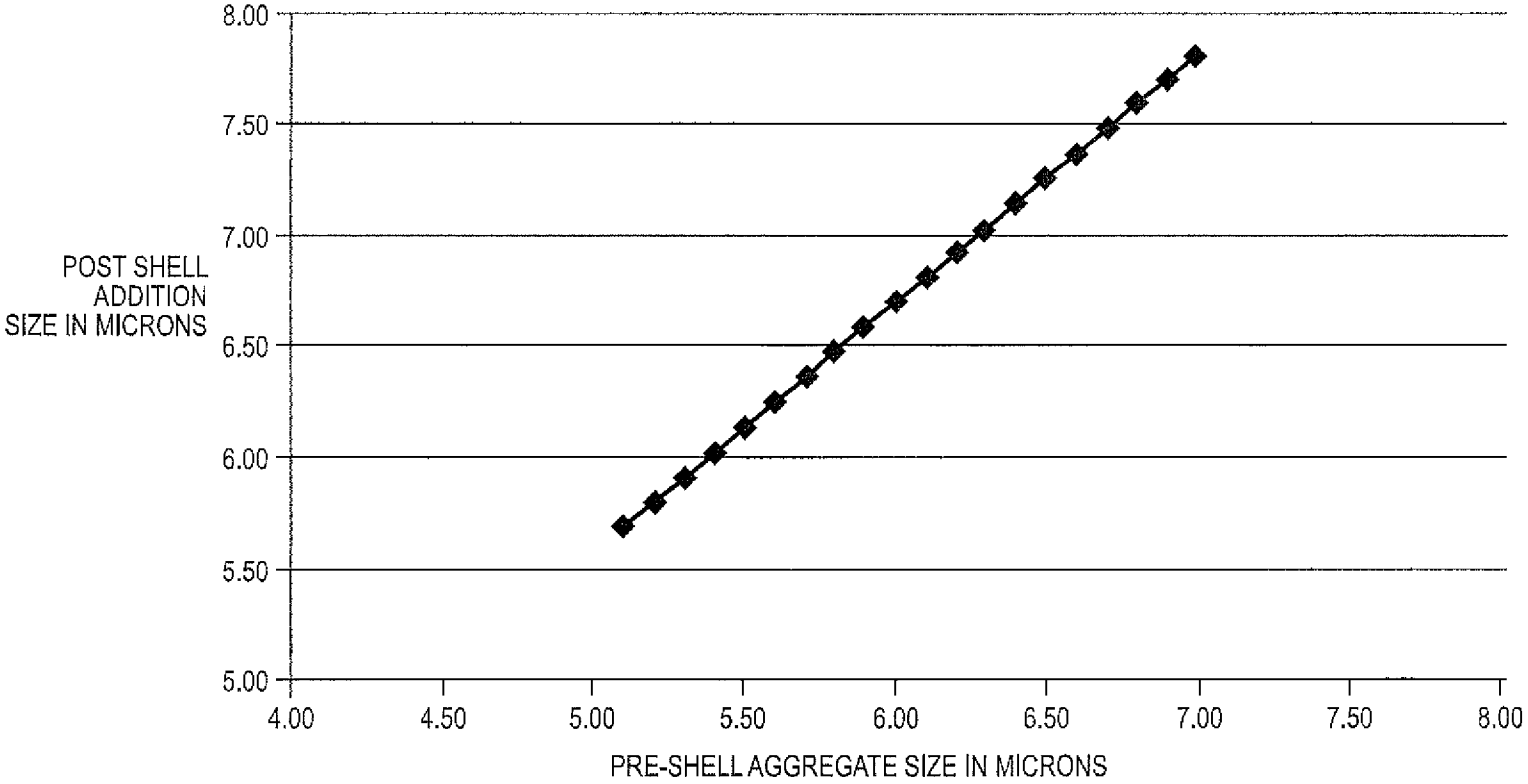
FIG. 1 is a graph showing the relationship between pre-shell average particle diameter sizes and post-shell average particle diameter sizes.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

"Optional" or "optionally" refer, for example, to instances in which subsequently described circumstances may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

Disclosed herein are methods of tightening charge distribution of toner particles by tightening the size distribution of the particles. Toner compositions made in accordance with these methods produce images having improved image quality stability compared to those produced with conventional toners. The disclosed toner compositions are suitable for use in machines having a selective development system, or single component development (SCD) system.

Latex Resin

Any monomer suitable for preparing a latex for use in a toner may be used to form the core and the shell of the toner particles. Suitable monomers useful in forming a latex polymer emulsion, and thus the resulting latex particles in the latex emulsion, include styrenes, acrylates, methacrylates, butadienes, isoprenes, acrylic acids, methacrylic acids, acrylonitriles, combinations thereof, and the like.

Suitable latex resins include those have a glass transition temperature Tg of from about 49° C. to about 61° C., such as from about 51° C. to about 59° C., from about 53° C. to about 57° C., or from about 51° C. to about 55° C.

The latex resin may include at least one polymer. Suitable polymers include styrene acrylates, styrene butadienes, styrene methacrylates, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), polyacrylonitrile-butyl acrylate-acrylic acid), and combinations thereof. The polymers may be block, random, or alternating copolymers.

The latex resin may include polyester resins, including those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is totally incorporated herein by reference), and branched polyester resins resulting from the reaction of dimethylterephthalate with 1,3-butanediol, 1,2-propanediol, and pentaerythritol, A poly(styrene-butyl acrylate) may be used as the latex resin. The glass transition temperature of this latex may be from about 35° C. to about 75° C., such as from about 35 to about 50° C., from about 40° C. to about 70° C., or from about 60 to about 75° C.

Waxes

The toner particles may also contain one or more waxes. A single wax may be added to toner formulations to improve particular toner properties, such as toner particle shape, presence, and amount of wax on the toner particle surface, charging and/or fusing characteristics, gloss, stripping, offset properties, and the like. Alternatively, a combination of waxes may be added to provide multiple properties to the toner composition.

Suitable waxes include natural vegetable waxes, natural animal waxes, mineral waxes, synthetic waxes, and functionalized waxes. Suitable natural vegetable waxes include carnauba wax, candelilla wax, rice wax, sumacs wax, jojoba oil, Japan wax, and bayberry wax. Suitable natural animal waxes include beeswax, panic wax, lanolin, lac wax, shellac wax, and spermaceti wax. Suitable mineral-based waxes include paraffin wax, microcrystalline wax, montan wax, ozokerite wax, ceresin wax, petrolatum wax, and petroleum wax. Suitable synthetic waxes include Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

The wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight (Mw) of from about 500 to about 2,000, such as from about 1,000 to about 1,500, while the commercially available polypropylenes used have a molecular weight of from about 1,000 to about 10,000. Suitable functionalized waxes include amines, amides, imides, esters, quaternary amines, carboxylic acids or acrylic polymer emulsion, for example, JONCRYL 74, 89, 130, 537, and 538, all available from Johnson Diversey, Inc., and chlorinated polyethylenes and polypropylenes commercially available from Allied Chemical and Petrolite Corporation and Johnson Diversey, Inc. The polyethylene and polypropylene compositions may be selected from those illustrated in British Pat. No. 1,442,835, the entire disclosure of which is totally incorporated herein by reference.

The toners may contain the wax in an amount of, for example, from about 1 to about 25 wt % of the toner, such as from about 1 to about 10 wt %, from about 5 to about 20 wt %, or from about 15 to about 25 wt %.

The wax may be a paraffin wax. Suitable paraffin waxes include paraffin waxes possessing modified crystalline structures, which may be referred to herein as modified paraffin waxes. Compared with conventional paraffin waxes, which may have a symmetrical distribution of linear carbons and branched carbons, the modified paraffin waxes may possess branched carbons in an amount of from about 1 to about 20 wt % of the wax, such as from about 8 to about 16 wt %, with linear carbons present in an in amount of from about 80 to about 99 wt %, or from about 84 to about 92 wt %.

In addition, the isomers, i.e., branched carbons, present in such modified paraffin waxes may have a number average molecular weight (Mn), of from about 520 to about 600, such as from about 550 to about 570, or about 560. The linear carbons, sometimes referred to as normals, present in such waxes may have a Mn of from about 505 to about 530, such as from about 512 to about 525, or about 518. The weight average molecular weight (Mw) of the branched carbons in the modified paraffin waxes may be from about 530 to about 580, such as from about 555 to about 575, and the Mw of the linear carbons in the modified paraffin waxes may be from about 480 to about 550, such as from about 515 to about 535.

For the branched carbons, the weight average molecular weight (Mw) of the modified paraffin waxes may demonstrate a number of carbon atoms of from about 31 to about 59 carbon atoms, such as from about 34 to about 50 carbon atoms, with a peak at about 41 carbon atoms, and for the linear carbons, the Mw may demonstrate a number of carbon atoms of from about 24 to about 54 carbon atoms, or from about 30 to about 50 carbon atoms, with a peak at about 36 carbon atoms.

The modified paraffin wax may be present in an amount of from about 2 to about 20 wt % by weight of the toner, such as from about 2 to about 10 wt %, from about 8 to about 16 wt %, or from about 14 to about 20 wt %.

Colorants

The toners may also contain at least one colorant. Suitable colorants or pigments include pigment, dye, mixtures of pigment and dye, mixtures of pigments, mixtures of dyes, and the like. For simplicity, the term "colorant" refers to colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %.

In general, suitable colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF), and carbon blacks such as REGAL 330 (Cabot), Carbon Black 5250 and 5750 (Columbian Chemicals), and the like, and mixtures thereof.

Additional colorants include pigments in water-based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like, and mixtures thereof. Other water based colorant dispersions include those commercially available from Clariant, for example, HOSTAFINE Yellow GR, HOSTAFINE Black T and Black TS, HOSTAFINE Blue B2G, HOSTAFINE Rubine F6B, and magenta dry pigment such as Toner Magenta 6BVP2213 and Toner Magenta EO2 that may be dispersed in water and/or surfactant prior to use.

Additional suitable colorants include magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like, and mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like, and mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, and mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components, may also be selected as pigments.

The colorant, such as carbon black, cyan, magenta, and/or yellow colorant, is incorporated in an amount sufficient to impart the desired color to the toner. In general, pigment or dye may be employed in an amount ranging from about 1 to about 35 wt % of the toner particles on a solids basis, such as from about 5 to about 25 wt %, or from about 5 to about 15 wt %.

Coagulants

Coagulants used in emulsion aggregation processes for making toners include monovalent metal coagulants, divalent metal coagulants, polyion coagulants, and the like. "Polyion coagulant" refers to a coagulant that is a salt or an oxide, such as a metal salt or a metal oxide, formed from a metal species having a valence of at least 3, at least 4, or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds may have from about 2 to about 13, such as from about 3 to about 8, aluminum ions present in the compound.

The coagulants may be incorporated into the toner particles during particle aggregation. As such, the coagulant may be present in the toner particles, exclusive of external additives and on a dry weight basis, in amounts of from 0 to about 5 wt % of the toner particles, such as from about greater than 0 to about 3 wt %.

Surfactants

Colorants, waxes, and other additives used to form toner compositions may be in dispersions that include surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

One, two, or more surfactants may be used. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt %, or from about 1 to about 3 wt %.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN™ and NEOGEN SC™ obtained from Daiichi Kogyo Seiyaku Co., Ltd., DOWFAX™ obtained from Dow Chemical, combinations thereof, and the like.

Suitable cationic surfactants include ammoniums, such as alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like; cetyl pyridinium bromide; halide salts of quaternized polyoxyethylalkylamines; dodecylbenzyl triethyl ammonium chloride; MIRAPOL and ALKAQUAT available from Alkaril Chemical Company; SANISOL (benzalkonium chloride) and SANISOL B-50 (benzyl dimethyl alkonium chloride) available from Kao Chemical; combinations thereof; and the like.

Suitable nonionic surfactants include alcohols, acids, and ethers, such as polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. Suitable commercially available surfactants include such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™ available from Rhone-Poulenc.

Initiators

Initiators may be added for formation of the latex polymer. Suitable initiators include water soluble initiators, such as ammonium persulfate, sodium persulfate and potassium persulfate; and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Additional suitable water-soluble initiators include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methylpropionamidine]dihydrochloride, 2,2'-azobis[N-(4-aminophenyl)-2-methylpropionamidine]tetrahydrochloride, 2,2'-azobis[2-methyl-N(phenylmethyl)propionamidine] dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochlo-ride, 2,2'-azobis[2-(5-hydroxy-3,4,5,6-tetrahydropyrimidin-2-yl) propane]di-hydrochloride, 2,2'-azobis{2-[1-(2-hydroxyethyl)-2-imidazolin-2-yl]propane}dihydrochloride, combinations thereof, and the like.

Initiators can be added in suitable amounts, such as from about 0.1 to about 8 wt % of the monomers, such as from about 0.1 to about 3 wt %, from about 0.2 to about 5 wt %, or from about 4 to about 8 wt %.

Chain Transfer Agents

Chain transfer agents may also be used in forming the latex polymer. Suitable chain transfer agents include dodecane thiol, octane thiol, carbon tetrabromide, combinations thereof, and the like, in amounts from about 0.1 to about 10 wt %, such as from about 0.1 to about 3 wt %, from about 0.2 to about 5 wt %, or from about 4 to about 10 wt %, to control the molecular weight properties of the latex polymer.

Functional Monomers

A functional monomer may be included when forming a latex polymer and the particles making up the polymer. Suitable functional monomers include monomers having carboxylic acid functionality. Such functional monomers may be of the following formula (I):

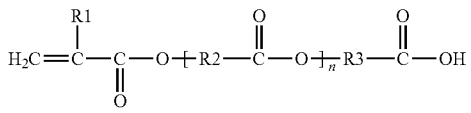

(I)

where R1 is hydrogen or a methyl group; R2 and R3 are independently selected from alkyl groups containing from about 1 to about 12 carbon atoms or a phenyl group; n is from about 0 to about 20, such as from about 1 to about 10. Examples of such functional monomers include beta carboxyethyl acrylate (β-CEA), poly(2-carboxyethyl)acrylate, 2-carboxyethyl methacrylate, combinations thereof, and the like. Other functional monomers that may be used include acrylic acid and its derivatives.

The functional monomer having carboxylic acid functionality may also contain a small amount of metallic ions, such as sodium, potassium, and/or calcium, to achieve better emulsion polymerization results. The metallic ions may be present in an amount from about 0.001 to about 10 wt % of the functional monomer having carboxylic acid functionality, such as from about 0.5 to about 5 wt %.

Where present, the functional monomer may be added in amounts from about 0.01 to about 5 wt % of the toner, such as from about 0.05 to about 2 wt %.

Aggregating Agents

Any aggregating agent capable of causing complexation may be used in forming toners of the present disclosure. Both alkali earth metal or transition metal salts may be used as aggregating agents. Alkali (II) salts may be selected to aggregate latex resin colloids with a colorant to enable the formation of a toner composite. Such salts include beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and combinations thereof. Suitable transition metal salts or anions include acetates of vanadium, niobium, tantalum, chromium, molybdenum, tungsten, manganese, iron, ruthenium, cobalt, nickel, copper, zinc, cadmium, or silver; acetoacetates of vanadium, niobium, tantalum, chromium, molybdenum, tungsten, manganese, iron, ruthenium, cobalt, nickel, copper, zinc, cadmium, or silver; sulfates of vanadium, niobium, tantalum, chromium, molybdenum, tungsten, manganese, iron, ruthenium, cobalt, nickel, copper, zinc, cadmium, or silver; aluminum salts such as aluminum acetate; aluminum halides such as polyaluminum chloride; combinations thereof; and the like.

Shell

A shell may be formed on the core. Any latex disclosed above used to form the core may be used to form the latex shell. For example, a styrene-n-butyl acrylate copolymer may be used to form the shell latex. The shell latex may have a glass transition temperature of from about 35° C. to about 75° C., such as from about 40° C. to about 70° C.

Where present, a shell latex may be applied by any method within the purview of the art, including dipping, spraying, and the like. The shell latex may be applied until the desired final size of the toner particles is achieved. The shell latex may be prepared by in-situ seeded semi-continuous emulsion copolymerization of the latex, and the shell latex may be added once core particles have formed.

Where present, the shell latex may be present in an amount of from about 20 to about 40 wt % of the dry toner particle, such as from about 20 to about 28 wt %, from about 26 to about 36 wt %, or from about 32 to about 40 wt % of the dry toner particle.

Gel Latex

A gel latex may be added to non-crosslinked latex resin suspended in the surfactant. A "gel latex" refers to a crosslinked resin or polymer, or mixtures thereof, or a non-crosslinked resin that has been subjected to crosslinking.

The gel latex may include submicron crosslinked resin particles having a size of from about 10 to about 300 nanometers (nm) in volume average diameter, such as from about 10 to about 80 nm, from about 20 to 100 nm, or from about 90 to about 300 nm in volume average diameter. The gel latex may be suspended in an aqueous phase of water containing a surfactant, wherein the surfactant may be present in an amount from about 0.3 about 10 wt % of total solids, such as from about 0.3 to about 3 wt %, from about 0.7 to about 5 wt %, or from about 4 to about 10 wt %.

The crosslinked resin may be a crosslinked polymer such as crosslinked styrene acrylates, styrene butadienes, and/or styrene methacrylates. Suitable crosslinked resins include crosslinked poly(styrene-alkyl acrylate), polystyrene-butadiene), poly(styrene-isoprene), poly(styrene-alkyl methacrylate), polystyrene-alkyl acrylate-acrylic acid), poly(styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly(alkyl acrylate-acrylonitrile-acrylic acid), and mixtures thereof.

A crosslinker, such as divinyl benzene or other divinyl aromatic or divinyl acrylate or methacrylate monomers may be used in the crosslinked resin. The crosslinker may be present in an amount of from about 0.01 to about 25 wt % of the crosslinked resin, such as from about 0.01 to about 12 wt %, from about 0.5 to about 20 wt %, or from about 15 to about 25 wt %.

Methods

Toners particles may be prepared by combining a latex resin with an optional wax, an optional surfactant, an optional colorant, an optional initiator, and additional optional additives to a reactor to form a mixture, and aggregating the mixture to form pre-shell aggregates. A shell resin then may be added to the pre-shell aggregates to form toner particles having a shell, and then recovering the toner particles. The resins may be prepared by any method within the purview of the art. One way the resins may be prepared is by emulsion polymerization methods, including semi-continuous emulsion polymerization.

Tighter size distribution may be achieved by taking into account the following three factors: the solids content during pre-shell aggregate formation, maintaining mixing speeds within certain parameters at certain stages of the process, and minimizing the temperature drop during shell latex addition.

The amount of solids content of the mixture from which the pre-shell aggregates are formed affects the size distribution of the pre-shell aggregates, and thus the size distribution of the final toner particles. "Solids content" refers to the total amount of solids in the reactor resulting from the addition of latex dispersion, wax dispersion, and colorant in the reactor. Solids content is expressed as a percentage and is calculated as the total amount of solids relative to the total weight of the solids and the water in the reactor. Tighter size distribution may be obtained by using a pre-shell aggregate mixture having a solids content within a range of from about 14 to about 16.5 wt %, or from about 15 to about 16 wt %, or from about 15.5 to about 16.5 wt %.

The amount of latex resin present in the pre-shell aggregate mixture may be from about 77 to about 83 wt %, such as from about 78 to about 82 wt %, from about 77 to about 81 wt %, or from about 79 to about 81 wt %, based on a total weight of the mixture.

The mixture containing the latex resin may be aggregated in a reactor having an impeller for mixing to form the pre-shell aggregates. Adjusting the tip seed of the impeller wheel during certain stages of the aggregation process can tighten particle size distribution. For example, during the initial homogenization of the pre-shell aggregate ingredients, the impeller may be operated at a tip speed of from about 920 to about 960 ft/min, such as from about 920 to about 935 ft/min, from about 930 to about 950 ft/min, from about 945 to about 960 ft/min, or at about 940 ft/min. When the pre-shell aggregates reach a target intermediate average particle diameter, the tip speed may be decreased.

The target intermediate average particle diameter may be from about 65% to about 85% of the target final pre-shell aggregate average particle diameter, such as from about 65% to about 72%, from about 70% to about 77%, from about 74% to about 81%, from about 78% to about 85%, or from about 74% to about 76%. As used herein, "average particle diameter" refers to the volume average diameter (D50v).

The target final pre-shell aggregate average particle diameter of from about 2.5 to about 12 μm, such as from about 3 to about 7 μm, or from about 4.5 to about 5.5 μm, or from about 4.8 to about 5.2 μm, or from about 5.4 to about 5.6 μm, or from about 5.2 to about 5.4 μm.

When the target intermediate average particle diameter is reached, the tip speed may be decreased to about 830 to about 870 ft/min, such as from about 830 to about 845 ft/min, from about 840 to about 860 ft/min, from about 855 to about 870 ft/min, or about 850 ft/min.

Then, while the pre-aggregates increase in size from the target intermediate average particle diameter to the target final average particle diameter, the tip speed may be adjusted one or more times so that the tip speed (Ts in ft/min) meets the following formula:

$$Ts=1644\text{ft/min}-204.9(\text{ft}/(\text{min}*\mu\text{m}))*\text{average particle diameter}(\mu\text{m}).$$

The reactor may additionally include a jacket. During the aggregation process, the jacket temperature may be set to a temperature that is about 2.2° C. to about 2.8° C. higher than the glass transition temperature of the latex used in the aggregation mixture, such as from about 2.2° C. to about 2.6° C., or from about 2.2° C. to about 2.4° C., or from about 2.4° C. to about 2.6° C. higher than the glass transition temperature of the latex used in the aggregation mixture. During shell addition, the jacket temperature may be set to a temperature that is about 3.3° C. to about 3.7° C. higher than the glass transition temperature of the latex used in the shell addition mixture, such as from about 3.3° C. to about 3.6° C., or from about 3.3° C. to about 3.5° C., or from about 3.4° C. to about 3.6° C. higher than the glass transition temperature of the latex used in the shell addition mixture.

After the addition of the shell resin, a base may be added to the mixture to stop the growth of the shell once a desired average particle diameter of the post-shell aggregate toner particles is achieved. The post-shell aggregate toner particles may have a particle diameter of from about 4 to about 15 μm, such as from about 4 to about 7 μm, or from about 8 to about 15 μm, or from about 5.5 to about 6.6 μm, or from about 5.5 to about 5.9 μm, or from about 5.8 to about 6.4 μm, or from about 6.2 to about 6.6 μm.

After the post-shell aggregate toner particles have reached their desired size, the toner particles may be coalesced by, for example, heating the mixture or by adding an acid to the mixture, followed by wet sieving, washing, and drying.

Additives

Suitable additives include any additives that enhance the properties of the toner composition. For example, the toner may include positive or negative charge control agents in an amount of from about 0.1 to about 10 wt % of the toner, such as from about 1 to about 5 wt %, or from about 1 to about 3 wt %. Suitable charge control agents include quaternary ammonium compounds inclusive of alkyl pyridinium halides; bisulfates; alkyl pyridinium compounds; organic sulfate and sulfonate compositions; cetyl pyridinium tetrafluoroborates; distearyl dimethyl ammonium methyl sulfate; aluminum salts such as BONTRON E88™, or zinc salts such as E-84 (Orient Chemical); combinations thereof, and the like.

Other additives include an organic spacer, such as polymethylmethacrylate (PMMA). The organic spacer may have a volume average diameter of from about 300 to about 600 nm, such as from about 300 to about 400 nm, or from about 350 to about 450 nm, such as 300 nm, 350 nm, 400 nm, 450 nm, or 500 nm.

Other additives include surface additives, color enhancers, etc. Surface additives that may be added to the toner compositions after washing or drying include metal salts, metal salts of fatty acids, colloidal silicas, metal oxides, strontium titanates, combinations thereof, and the like, which additives may each be present in an amount of from about 0.1 to about 10 wt % of the toner, such as from about 0.5 to about 7 wt %. Other additives include zinc stearate and AEROSIL R972® available from Degussa. The coated silicas of U.S. Pat. Nos. 6,190,815 and 6,004,714, the entire disclosures of which are totally incorporated herein by reference, may also be selected in amounts of from about 0.05 to about 5 wt % of the toner, such as from about 0.1 to about 2 wt %. These additives may be added during the aggregation process or blended into the formed toner product.

Toner Properties

Properties of the toner particles may be determined by any suitable technique and apparatus. Volume average particle diameter D50v, GSDv, and GSDn may be measured by means of a measuring instrument such as a Beckman Coulter Multisizer 3, operated in accordance with the manufacturer's instructions. GSDv refers to the upper geometric standard deviation (GSDv) by volume (coarse level) for (D84/D50). GSDn refers to the geometric standard deviation (GSDn) by number (fines level) for (D50/D16). The particle diameters at which a cumulative percentage of 16% of the total toner particles are attained are defined as volume D16, the particle diameters at which a cumulative percentage of 50% of the total toner particles are attained are defined as volume D50, and the particle diameters at which a cumulative percentage of 84% are attained are defined as volume D84. The closer to 1.0 that the GSD value is, the less size dispersion there is among the particles.

Emulsion aggregation processes provide greater control over the distribution of toner particle sizes by limiting the amount of both fine and coarse toner particles in the toner. The toner particles made in accordance to this disclosure may have a relatively narrow particle size distribution with a GSDn of from about 1.05 to about 1.25, such as from about 1.05 to about 1.12, from about 1.10 to about 1.20, or from about 1.18 to about 1.25. The toner particles may also exhibit a GSDv in the range of from about 1.05 to about 1.25, such as from about 1.05 to about 1.12, from about 1.10 to about 1.20, or from about 1.18 to about 1.25.

A ratio of the average particle diameter of the post-shell aggregate toner particles to an average particle diameter of the pre-shell aggregate toner particles may be from about 1.1 to about 1.2, such as from about 1.1 to about 1.14, from about 1.12 to about 1.18, from about 1.16 to about 1.2, or about 1.1157. "Post-shell aggregate toner particles" refer to the toner particles after the shell latex has been added, but prior to the inclusion of other additives, such as those disclosed above in the "Additives" section.

By optimizing the particle size, in some cases from about 5.7 to about 5.9 μm, toners of the present disclosure may be especially suited for bladeless cleaning systems, i.e., single component development (SCD) systems. With a proper sphericity, the toners of the present disclosure may assist in optimized machine performance.

The toner particles may have a circularity of about 0.940 to about 0.999, such as from about 0.950 to about 0.998, or from about 0.960 to about 0.998, or from about 0.970 to about 0.998, or from about 0.980 to about 0.990, from about greater than or equal to 0.962 to about 0.999, or from about greater than or equal to 0.965 to about 0.990. A circularity of 1.000 indicates a completely circular sphere. Circularity may be measured with, for example, a Sysmex FPIA 2100 or 3000 analyzer.

The toner particles may have a shape factor of from about 105 to about 160, such as from about 110 to about 140, or from about 120 to about 150 SF1*a. Scanning electron microscopy (SEM) may be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

The toner particles may have a surface area of from about 0.5 $m^2/g$ to about 1.4 $m^2/g$, such as from about 0.6 $m^2/g$ to about 1.2 $m^2/g$, or from about 0.7 $m^2/g$ to about 1.0 $m^2/g$. Surface area may be determined by the Brunauer, Emmett, and Teller (BET) method. BET surface area of a sphere can be calculated by the following equation:

$$\text{Surface Area}(m^2/g)=6/(\text{Particle Diameter}(um)*\text{Density}(g/cc)).$$

The toner particles may have a weight average molecular weight (Mw) in the range of from about 20,000 to about 100,000 pse, such as from about 20,000 to about 60,000 pse, or from about 40,000 to about 100,000 pse, a number average molecular weight (Mn) of from about 8,000 to about 40,000 pse, such as from about 8,000 to about 25,000 pse, or from about 20,000 to about 40,000 pse, and an MWD (a ratio of the Mw to Mn of the toner particles, a measure of the polydispersity, or width, of the polymer) of from about 1.2 to about 10, such as from about 1.2 to about 5, or from about 4 to about 10.

The characteristics of the toner particles may be determined by any suitable technique and apparatus and are not limited to the instruments and techniques indicated hereinabove.

Further, the toners, if desired, can have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values (Mp) for the binder, which represents the highest peak of the Mw. In the present disclosure, the binder can have Mp values in the range of from about 5,000 to about 50,000 pse, such as from about 7,500 to about 45,000 pse, or from about 15,000 to about 30,000 pse.

In an electrophotographic apparatus, the lowest temperature at which toner adheres to the fuser roll is called the cold offset temperature; the maximum temperature at which the toner does not adhere to the fuser roll is called the hot offset temperature. When the fuser temperature exceeds the hot offset temperature, some of the molten toner adheres to the fuser roll during fixing, is transferred to subsequent substrates (phenomenon known as "offsetting"), resulting in blurred images. Between the cold and hot offset temperatures of the toner is the minimum fix temperature (MFT), which is the minimum temperature at which acceptable adhesion of the toner to the support medium occurs. The difference between minimum fix temperature and hot offset temperature is called the fusing latitude. The rheology of toners, especially at high temperatures, may be affected by the length of the polymer chain utilized to form the binder resin as well as any crosslinking or the formation of a polymer network in the binder resin.

The toners may possess low minimum fix temperatures, i.e., temperatures at which images produced with the toner may become fixed to a substrate, of from about 135° C. to about 220° C., such as from about 145° C. to about 215° C., or from about 155° C. to about 185° C.

The toner compositions may have a gloss, measured at the minimum fixing temperature (MFT), of from about 5 to about 30 gloss units, such as from about 5 to about 20 gloss units, or from about 10 to about 19 gloss units as measured on a BYK 75 degree micro gloss meter. "Gloss units" refers to Gardner Gloss Units (ggu) measured on plain paper (such as Xerox 90 gsm COLOR XPRESSIONS+paper or Xerox 4200 paper). The toners may reach 20 gloss units (TG40) at a temperature of, for example, from about 170° C. to about 210° C., such as from about 180° C. to about 200° C., or from about 185° C. to about 195° C.

The melt flow index (MFI) of the toners may be determined by methods within the purview of those skilled in the art, including the use of a plastometer. For example, the MFI of the toner may be measured on a Tinius Olsen extrusion plastometer at about 130° C. with about 10 kilograms load force. Samples may then be dispensed into the heated barrel of the melt indexer, equilibrated for an appropriate time, such as from about five minutes to about seven minutes, and then the load force of about 10 kg may be applied to the melt indexer's piston. The applied load on the piston forces the molten sample out a predetermined orifice opening. The time for the test may be determined when the piston traveled one inch. The melt flow may be calculated by the use of the time, distance, and weight volume extracted during the testing procedure.

MFI as used herein refers to the weight of a toner (in grams) that passes through an orifice of length L and diameter D in a 10 minute period with a specified applied load (as noted above, 10 kg). An MFI unit of 1 thus indicates that only 1 gram of the toner passed through the orifice under the specified conditions in 10 minutes time, "MFI units" as used herein thus refers to units of grams per 10 minutes.

Toners of the present disclosure subjected to this procedure may have varying MFI depending on the pigment utilized to form the toner. A black toner may have an MFI from about 10 gm/10 min to about 100 gm/10 min, such as from about 15 gm/10 min to about 47 gm/10 min; a cyan toner may have an MFI from about 30 gm/10 min to about 100 gm/10 min, such as from about 36 gm/10 min to about 46 gm/10 min; a yellow toner may have an MFI from about 12 gm/10 min to about 100 gm/10 min, such as from about 16 gm/10 min to about 35 gm/10 min; and a magenta toner may have an MFI of from about 45 gm/10 min to about 100 gm/10 min, such as from about 48 gm/10 min to about 52 gm/10 min The toners may have a fusing percentage of from about 50% to about 100%, or from about 60% to about 90%, or from about 50% to about 70%. The fusing percentage of an image may be evaluated in the following manner. Toner is fused from low to high temperatures depending upon initial set point. Toner adherence to paper is measured by tape removal of the areas of interest with subsequent density measurement. The density of the tested area is divided by the density of the area before removal then multiplied by 100 to obtain percent fused. The optical density is measured with a spectrometer (for example, a 938 Spectrodensitometer, manufactured by X-Rite). Then, the optical densities thus determined are used to calculate the fusing ratio according to the following equation.

$$\text{Fusing}(\%)=(\text{Area after removal})/(\text{Area before removal})\times 100$$

Crease fix MFT is measured by folding images that have been fused over a wide range of fusing temperatures and then rolling a defined mass across the folded area. The print can also be folded using a commercially available folder such as the Duplo D-590 paper folder. The sheets of paper are then unfolded and toner that has been fractured from the sheet of paper is wiped from the surface. Comparison of the fractured area is then made to an internal reference chart. Smaller fractured areas indicate better toner adhesion and the temperature required to achieve acceptable adhesion is defined as the crease fix MFT. The toner compositions may have a crease fix MFT of, for example, from about 115° C. to about 145° C., such as from about 120° C. to about 140° C., or from about 125° C. to about 135° C.

The toners may also possess excellent charging characteristics when exposed to extreme relative humidity (RH) conditions. The low-humidity zone may be about 12° C./15% RH, while the high humidity zone may be about 28° C./85% RH. Toners of the present disclosure may possess a parent toner charge per mass ratio (Q/M) of from about −2 μC/g to about −70 μC/g, such as from about −30 μC/g to about −65 μC/g, and a final toner charging after surface additive blending of from −25 μC/g to about −50 μC/g, such as from about −35 μC/g to about −45 μC/g.

The toners may exhibit a high hot offset temperature of, for example, from about 200° C. to about 230° C., such as from about 200° C. to about 220° C., or from about 205° C. to about 215° C.

The toner compositions may have a flow, measured by Hosakawa Powder Flow Tester. Toners of the present disclosure may exhibit a flow of from about 10 to about 55%, such as from 30 to about 50%, or from about 15 to about 40%.

The toner composition may be measured for compressibility, which is partly a function of flow. Toners of the present disclosure may exhibit a compressibility of from about 8 to about 16%, such as from about 12 to about 16%, or from about 9 to about 14% at 9.5 to 10.5 kPa.

The density of the toner compositions may be measured by densitometer. Toners of the present disclosure may exhibit a density of from about 1.2 to about 1.8, or from about 1.3 to about 1.6, or from about 1.5 to about 1.7.

Imaging

Toners in accordance with the present disclosure may be used in a variety of imaging devices including printers, copy machines, and the like. The toners generated in accordance with the present disclosure are excellent for imaging processes, especially xerographic processes, and are capable of providing high quality colored images with excellent image resolution, acceptable signal-to-noise ratio, and image uniformity. Further, toners of the present disclosure may be selected for electrophotographic imaging and printing processes such as digital imaging systems and processes.

Any known type of image development system may be used in an image developing device to form images with the toner set described herein, including, for example, magnetic brush development, single component development (SCD), non-magnetic single component development, hybrid scavengeless development (HSD), and the like. Because these development systems are known in the art, and further explanation of the operation of these devices to form an image is not needed.

EXAMPLES

The following Examples are illustrative only and are not intended to limit the scope of the present disclosure. Also, parts and percentages are by weight unless otherwise indicated. "Room temperature" refers to a temperature of from about 20° C. to about 30° C.

Example 1

A toner was prepared by an emulsion aggregation process. A reactor was initially charged with 29.7 kg of de-ionized water, 15.7 kg of a styrene-butylacrylate resin in a latex emulsion having a solids content of about 41.5%, 0.71 kg of a cyan pigment dispersion having a solids content of about 17%, and about 3.47 kg of a carbon black pigment dispersion having a solids content of about 17%. The contents of the reactor were mixed, and then 1 kg of a polyethylene wax dispersion having a solids content of around 31% and 1 kg of an acid solution with polyaluminum chloride was added to the reactor. The wax dispersion was added through a homogenization loop to assure that larger agglomerates were broken down into smaller sized particles.

After the wax dispersion and agglomerating agent solution were added to the reactor, all of the components in the reactor were homogenized for 6 min until the size of the particles in the dispersion was within a target range. The mixture was aggregated by operating the impeller at a tip speed of 940 ft/min. Once the average particle diameter of the pre-shell aggregate was 4 μm, the tip speed Ts was reduced to 850 ft/min. After the average particle diameter of the pre-shell aggregate reached 5.3 μm, the tip speed Ts was adjusted to a value represented by Ts=1644 ft/min−204.9(ft.(min*μm)) *average particle diameter (μm). During this aggregation process, the temperature of a jacket of the reactor was about 57.5° C. (2.5° C. greater than the glass transition temperature Tg of the latex).

After the pre-shell aggregate reached an average particle diameter size of 5.3 μm, the shell resin (an additional 7.59 kg of a styrene-butylacrylate resin in a latex emulsion) was added to the mixture. At this time, the temperature of the jacket was increased to 58.5° C. (3.5° C. greater than the glass transition temperature Tg of the latex).

Once the target/final size was achieved, the growth of the particles was stopped by the addition of sodium hydroxide until the slurry reached a pH of from 4.5 to 4.9. Then, the batch target temperature was raised to 96° C. When the slurry reached a temperature of 90° C., the pH of the batch was adjusted by the addition of nitric acid until the pH of the slurry reached a value of 3.98 to 4.02.

Once the batch reached 96° C., the temperature of the slurry was maintained, and the circularity of the particles was monitored over time. When the circularity reached the target value of 0.988, the temperature of the slurry was lowered to 53° C. at a rate of 0.6° C./min. When the temperature of the slurry reached 57° C., its pH was adjusted by the addition of sodium hydroxide until the pH of the slurry reached a value of 7.5 to 7.9.

After the slurry containing the particles having the desired size and circularity was made, the slurry underwent a series of steps referred to as downstream operations. These operations included sieving of the slurry to remove the oversize particles that may have been formed due to the high temperature in the reactor, washing the particles to remove surfactants or other ionic species that may impart undesired charging properties, and removing excess moisture by drying the particles.

Figure 2:
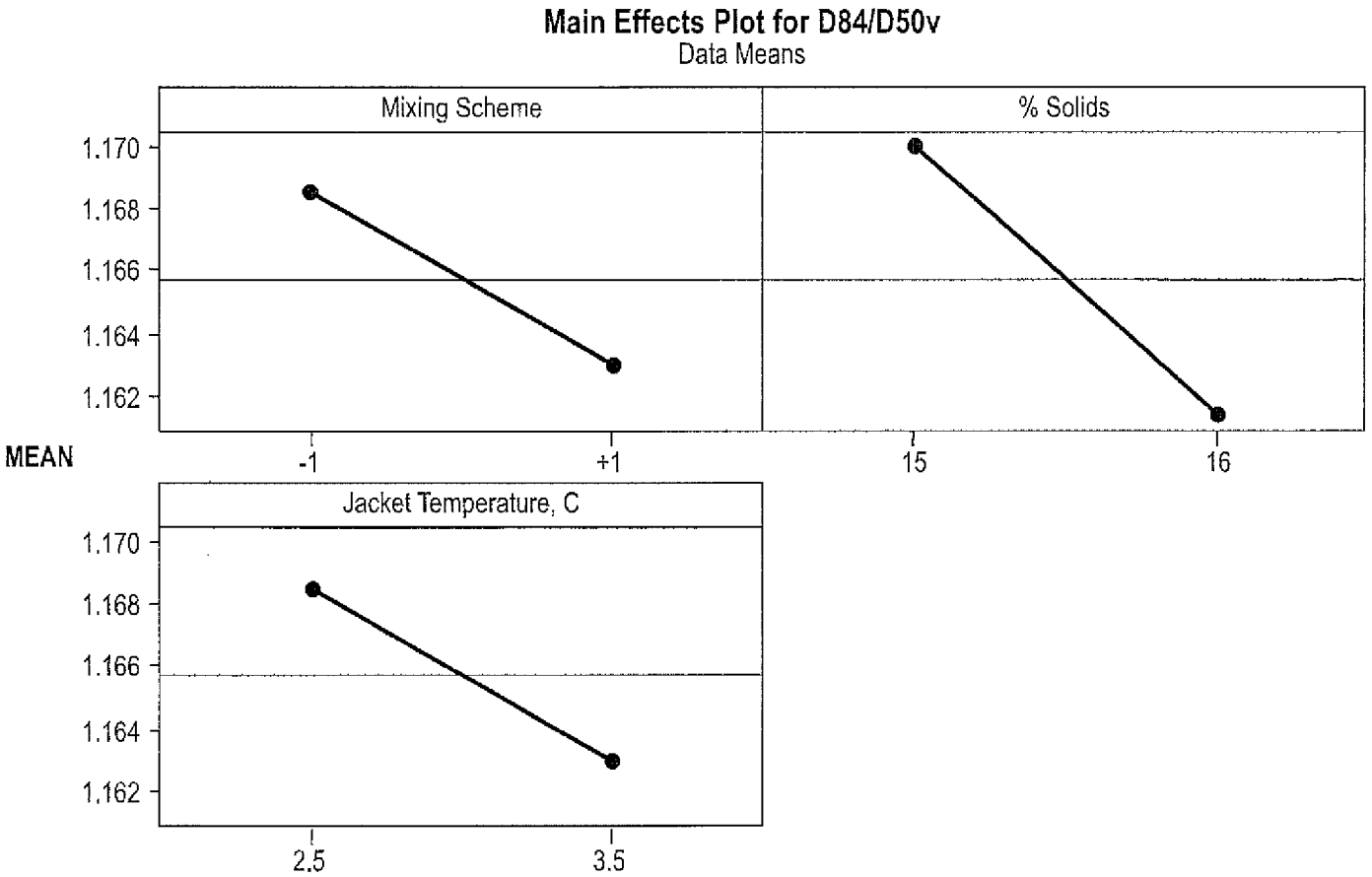
FIG. 2 is a graph showing the results of Example 1.
Figure 3:
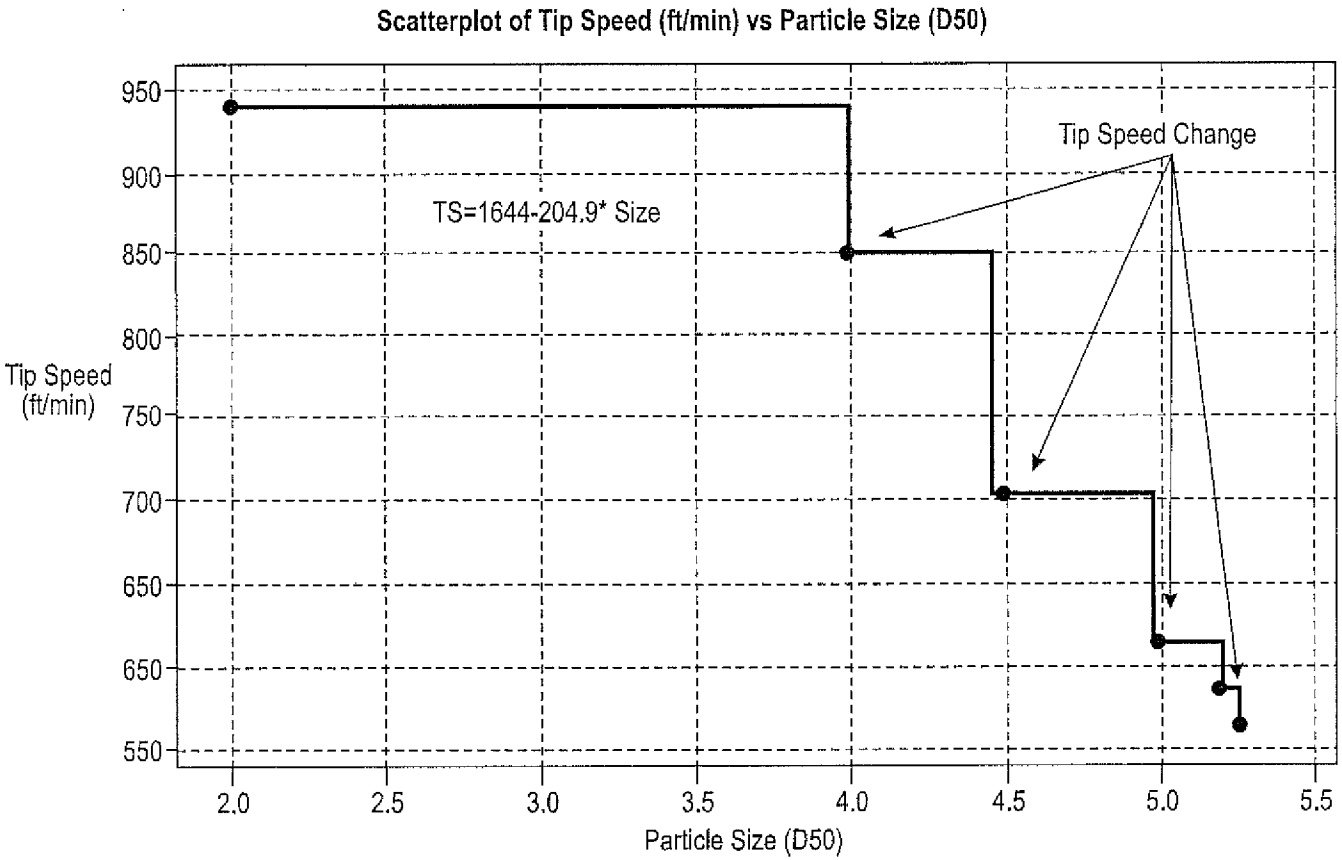
FIG. 3 is a graph showing the tip speed vs. particle size of Example 1.

The effects of the tip speed, the percentage of solids present in the pre-shell aggregate, and jacket temperature on the volume average particle size distribution index GSDv is shown graphically in FIG. 2. The changes in tip speed at the different particle sizes are shown graphically in FIG. 3.

Comparative Example 1

Toner particles were made using the same proportion of ingredients as in Example 1. However, the tip speed and the jacket temperature set points during the pre-shell aggregation and shell formation step were different.

Particularly, the mixture was aggregated by operating the impeller at a tip speed of 820 ft/min. Once the average particle diameter of the pre-shell aggregate was 4 μm, the tip speed Ts was reduced to 650 ft/min. Tip speed adjustments from this point forward took place such that the tip speed was from about 83% to about 88% of that in Example 1. During this aggregation process, the temperature of the jacket of the reactor was about 57.5° C. (2.5° C. greater than the glass transition temperature Tg of the latex). However, the jacket temperature during the shell formation step was also about 57.5° C.

As shown below, Table 1 summarizes the tip speed conditions and the temperature conditions of Example 1 and Comparative Example 1.

TABLE 1

| | Tip Speed Conditions | | Temperature Conditions, ° C. | |
|---|---|---|---|---|
| Process | Particle D50 | Tip Speed (ft/min) | Aggregation | Shell Formation |
| Example 1 | 2.0 | 940 | 57.5 | 58.5 |
| | 4.0 | 850 | | |
| | 4.5 | 706 | | |
| | 5.0 | 613 | | |
| | 5.3 | 588 | | |
| Comparative Example 1 | 2.0 | 820 | 57.5 | 57.5 |
| | 4.0 | 660 | | |
| | 4.5 | 565 | | |
| | 5.0 | 518 | | |
| | 5.3 | 490 | | |

Results

As shown in Table 2, the volume median D50 of Example 1 was slightly greater than the volume median of Comparative Example 1, while the GSDv and GSDn of Example 1 were lower than the GSDv and GSDn of Comparative Example 1, indicating that the toner produced by Example 1 has an improved particle size distribution compared to Comparative Example 1. Thus, Example 1 also has an improved toner charge distribution as compared to Comparative Example 1.

TABLE 2

| Parameter | Comparative Example 1 | Example 1 |
|---|---|---|
| Volume Median | 5.83 | 5.85 |
| GSDv | 1.18 | 1.16 |
| GSDn | 1.21 | 1.18 |

Figure 4:
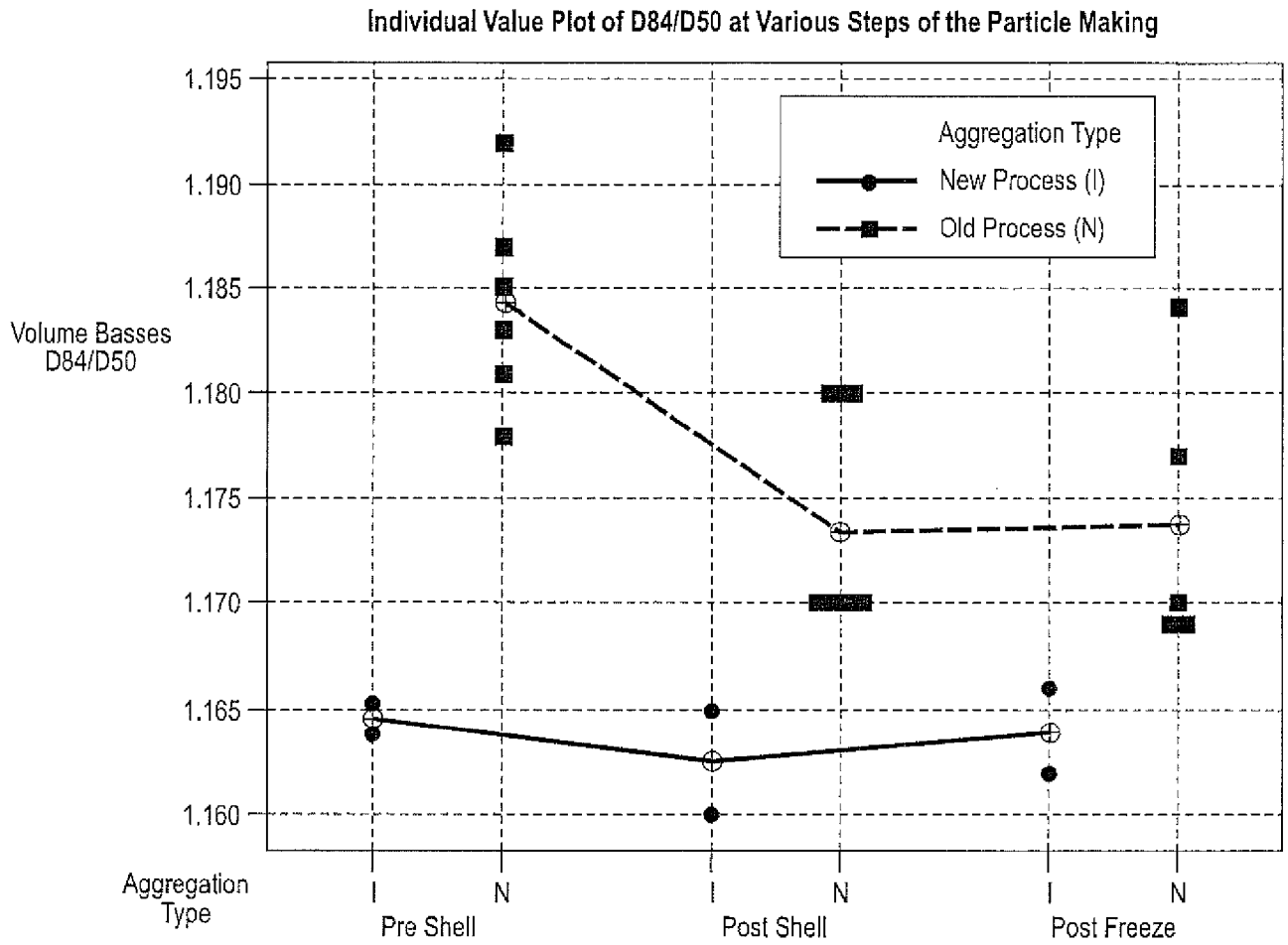
FIG. 4 is a graph showing individual value plots of D84/D50 at various stages during the manufacturing of the toner particles according to Example 1 and Comparative Example 1.
Figure 5:
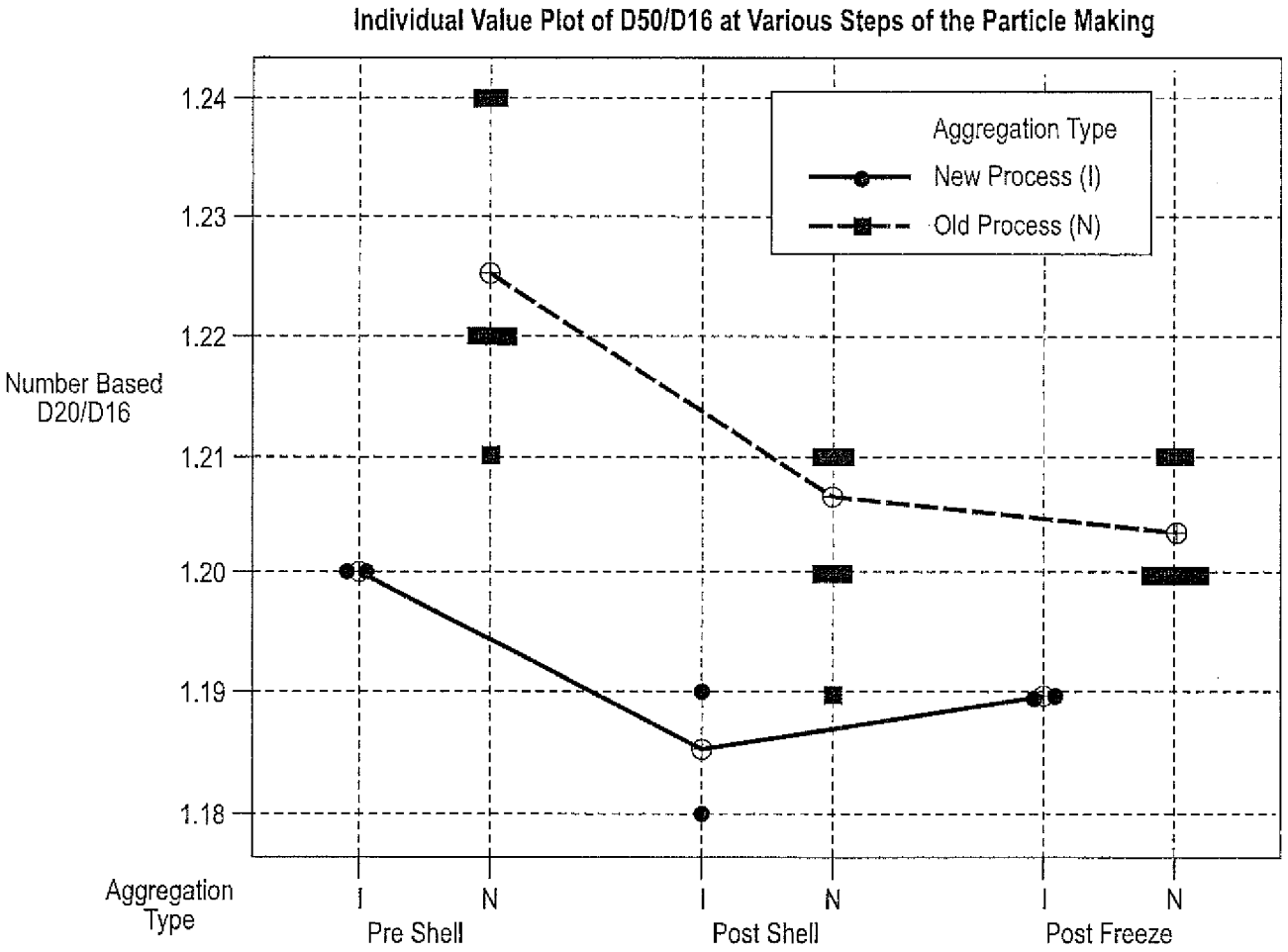
FIG. 5 is a graph showing individual value plots of the D50/D16 parameter at different stages during the manufacturing of the toner particles according to Example 1 and Comparative Example 1.

FIGS. 4 and 5 show the D84/D50 and D50/D15 parameters for Example 1 and Comparative Example 1 at different points in time during the manufacture of the toner particles. Example 1 corresponds to "New Process (I)" in FIGS. 4 and 5, and Comparative Example 1 corresponds to "Old Process (N)."

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of making toner particles comprising:

a core comprising a styrene-butylacrylate latex resin, the core having a glass transition temperature Tg of from about 51° C. to about 59° C.; and a shell comprising a styrene-butylacrylate latex resin surrounding the core, the shell having a glass transition temperature Tg of from about 40° C. to about 70° C.;

wherein:

the volume average particle diameter of the core is from about 4.5 to about 5.5 μm;

a ratio of an average particle diameter of the toner particles to an average particle diameter of the core is from about 1.1 to about 1.2;

the toner particles have:

a volume average particle diameter of from about 5.5 to about 5.9 μm;

a weight average molecular weight (Mw) in a range of from about 20,000 pse to about 60,000 pse;

a number average molecular weight (Mn) in a range of from about 8,000 pse to about 25,000 pse;

a ratio of Mw to Mn of from about 1.2 to about 5.0;

a particle size distribution with a lower number ratio geometric standard deviation (GSDn) of from about 1.05 to about 1.12, and an upper geometric standard deviation by volume (GSDv) of from about 1.05 to about 1.12;

a circularity of from about 0.965 to about 0.999;

a shape factor of from about 120 to about 150; and a surface area of from about 0.7 $m^2/g$ to about 1.0 $m^2/g$;

the toner composition has:

a crease minimum fix temperature (MFT) of from about 155° C. to about 185° C.;

an offset temperature of from about 205° C. to about 215° C.;

a compressibility of from about 9% to about 14% at 9.5 to 10.5 kPa;

a density of from about 1.3 to about 1.8;

a gloss, measured at the minimum fixing temperature (MFT), of from about 5 to about 20 gloss units; and a parent toner charge per mass ratio (Q/M) of from about −30 μC/g to about −65 μC/g;

the method comprisings:

forming a pre-shell aggregate mixture by adding to a reactor pre-shell aggregate ingredients, the pre-shell aggregate ingredients comprising:

a latex resin;

optionally a wax;

optionally a colorant;

optionally a surfactant;

optionally a coagulant;

optionally a chelating agent; and optionally one or more additional additives, the reactor comprising a mixing impeller and a heating jacket;

performing pre-shell aggregation while homogenizing the pre-shell aggregate mixture with the impeller at an initial tip speed to form pre-shell aggregates;

decreasing the tip speed to a second tip speed when the pre-shell aggregates reach a target intermediate average particle diameter; and then decreasing the tip speed at one or more intervals between when the pre-shell aggregates reach the target intermediate average particle diameter and when the pre-shell aggregates reach a target final average particle diameter so that the tip speed meets the following formula:

$$\text{tip speed}=1644\text{ft/min}-204.9(\text{ft}/(\text{min}*\mu\text{m}))*\text{average particle diameter}(\mu\text{m});$$

stopping pre-shell aggregation when the pre-shell aggregates reach the target final average particle diameter;

adding a shell latex to the pre-shell aggregates; and forming shells around the pre-shell aggregates to obtain post-shell aggregates, wherein a ratio of an average particle diameter of the post-shell aggregates to an average particle diameter of the pre-shell aggregates is from about 1.1 to about 1.

2. The method of claim 1, wherein the initial tip speed is in a range of from about 920 to about 960 ft/min.

3. The method of claim 2, wherein the second tip speed is in a range of from about 830 to about 870 ft/min.

4. The method of claim 2, wherein the target intermediate average particle diameter is from about 65% to about 85% of the target final pre-shell aggregate average particle diameter.

5. The method of claim 1, wherein, during pre-shell aggregation, the heating jacket is set to a temperature that is about 2.2° C. to about 2.8° C. higher than a glass transition temperature of the latex used in the pre-shell aggregate mixture.

6. The method of claim 5, wherein, during shell formation, the heating jacket is set to a temperature that is about 3.3° C. to about 3.7° C. higher than a glass transition temperature of the shell latex.

7. The method of claim 1, wherein a solids content of the pre-shell aggregate mixture is within a range of from about 14 to about 16.5 wt %.

8. The method of claim 1, wherein the post-shell aggregates have a particle size distribution with a lower number ratio geometric standard deviation (GSDn) of from about 1.18 to about 1.20, and an upper geometric standard deviation by volume (GSDv) of from about 1.16 to about 1.17.

9. The method of claim 1, wherein a ratio of an average particle diameter of the post-shell aggregates to an average particle diameter of the pre-shell aggregates is from about 1.1 to about 1.2.

10. The method of claim 1, wherein the target final average particle diameter of the pre-shell aggregates is from about 4.5 μm to about 5.5 μm.

11. A toner composition comprising toner particles comprising:

a core comprising a styrene-butylacrylate latex resin, the core having a glass transition temperature Tg of from about 51° C. to about 59° C.; and a shell comprising a styrene-butylacrylate latex resin surrounding the core, the shell having a glass transition temperature Tg of from about 40° C. to about 70° C.;

wherein:

the volume average particle diameter of the core is from about 4.5 to about 5.5 μm;

a ratio of an average particle diameter of the toner particles to an average particle diameter of the core is from about 1.1 to about 1.2;

the toner particles have:

a volume average particle diameter of from about 5.5 to about 5.9 μm;

a weight average molecular weight (Mw) in a range of from about 20,000 pse to about 60,000 pse;

a number average molecular weight (Mn) in a range of from about 8,000 pse to about 25,000 pse;

a ratio of Mw to Mn of from about 1.2 to about 5.0;

a particle size distribution with a lower number ratio geometric standard deviation (GSDn) of from about 1.05 to about 1.12, and an upper geometric standard deviation by volume (GSDv) of from about 1.05 to about 1.12;

wherein the toner composition has:

a circularity of from about 0.965 to about 0.999;

a shape factor of from about 120 to about 150; and a surface area of from about 0.7 $m^2/g$ to about 1.0 $m^2/g$;

a crease minimum fix temperature (MFT) of from about 155° C. to about 185° C.;

an offset temperature of from about 205° C. to about 215° C.;

a compressibility of from about 9% to about 14% at 9.5 to 10.5 kPa;

a density of from about 1.3 to about 1.8;

a gloss, measured at the minimum fixing temperature (MFT), of from about 5 to about 20 gloss units:

a parent toner charge per mass ratio (Q/M) of from about −30 μC/g to about −65 μC/g.

12. A single component developer, comprising:

a toner composition comprising toner particles comprising:

a core comprising a styrene-butylacrylate latex resin, the core having a glass transition temperature Tg of from about 51° C. to about 59° C.; and a shell comprising a styrene-butylacrylate latex resin surrounding the core, the shell having a glass transition temperature Tg of from about 40° C. to about 70° C.;

wherein:

the volume average particle diameter of the core is from about 4.5 to about 5.5 μm;

a ratio of an average particle diameter of the toner particles to an average particle diameter of the core is from about 1.1 to about 1.2;

the toner particles have:

a volume average particle diameter of from about 5.5 to about 5.9 μm;

a weight average molecular weight (Mw) in a range of from about 20,000 pse to about 60,000 pse;

a number average molecular weight (Mn) in a range of from about 8,000 pse to about 25,000 pse;

a ratio of Mw to Mn of from about 1.2 to about 5.0;

a particle size distribution with a lower number ratio geometric standard deviation (GSDn) of from about 1.05 to about 1.12, and an upper geometric standard deviation by volume (GSDv) of from about 1.05 to about 1.12;

a circularity of from about 0.965 to about 0.999;

a shape factor of from about 120 to about 150; and a surface area of from about 0.7 $m^2/g$ to about 1.0 $m^2/g$;

the toner composition has:

a crease minimum fix temperature (MFT) of from about 155° C. to about 185° C.;

an offset temperature of from about 205° C. to about 215° C.;

a compressibility of from about 9% to about 14% at 9.5 to 10.5 kPa;

a density of from about 1.3 to about 1.8;

a gloss, measured at the minimum fixing temperature (MFT), of from about 5 to about 20 gloss units; and a parent toner charge per mass ratio (Q/M) of from about −30 μC/g to about −65 μC/g.

* * * * *